US009673577B2

(12) United States Patent
Chang

(10) Patent No.: US 9,673,577 B2
(45) Date of Patent: Jun. 6, 2017

(54) POWER PLUG DEVICE AND THE MANUFACTURING METHOD THEREOF

(71) Applicant: PHIHONG TECHNOLOGY CO., LTD., Taoyuan County (TW)

(72) Inventor: Chun Feng Chang, Taoyuan County (TW)

(73) Assignee: Phihong Technology Co., Ltd., Taoyuan (TW)

( * ) Notice: Subject to any disclaimer, the term of this patent is extended or adjusted under 35 U.S.C. 154(b) by 0 days.

(21) Appl. No.: 15/057,586

(22) Filed: Mar. 1, 2016

(65) Prior Publication Data

US 2017/0098912 A1 Apr. 6, 2017

(30) Foreign Application Priority Data

Oct. 6, 2015 (TW) ..... 104132855 A

(51) Int. Cl.

| | |
|---|---|
| ***H01R 13/52*** | (2006.01) |
| ***H01R 24/28*** | (2011.01) |
| ***H01R 13/504*** | (2006.01) |
| ***H01R 13/58*** | (2006.01) |
| ***H01R 43/20*** | (2006.01) |
| ***H01R 43/00*** | (2006.01) |
| *H01R 103/00* | (2006.01) |

(52) U.S. Cl.

CPC ..... *H01R 24/28* (2013.01); *H01R 13/504* (2013.01); *H01R 13/5202* (2013.01); *H01R 13/5825* (2013.01); *H01R 43/005* (2013.01); *H01R 43/205* (2013.01); *H01R 13/5216* (2013.01); *H01R 2103/00* (2013.01)

(58) Field of Classification Search

None

See application file for complete search history.

(56) References Cited

U.S. PATENT DOCUMENTS

| | | | | |
|---|---|---|---|---|
| 5,595,503 | A * | 1/1997 | Pittman | H01R 13/56 439/11 |
| 6,991,475 | B2 * | 1/2006 | Dreyer | H01R 13/5216 439/276 |
| 7,766,681 | B1 * | 8/2010 | Wang | H01R 13/5216 439/276 |
| 8,619,413 | B2 * | 12/2013 | Gausepohl | H01R 13/5216 174/50 |
| 9,011,179 | B2 * | 4/2015 | Siahaan | H01R 13/504 439/606 |
| 2010/0240230 | A1 * | 9/2010 | Lee | H01R 9/03 439/38 |
| 2012/0052702 | A1 * | 3/2012 | Zou | H01R 13/7135 439/95 |
| 2015/0171574 | A1 * | 6/2015 | Little | H01R 24/60 439/78 |

* cited by examiner

*Primary Examiner* — Tho D Ta

(74) *Attorney, Agent, or Firm* — Muncy, Geissler, Olds & Lowe, P.C.

(57) ABSTRACT

This invention provides a power plug device and the manufacturing method thereof, the power plug device comprises a power-connected base; a cover is configured to the power-connected base, wherein the cover can cover the internal components of the power-connected base, such as at least one plug and a printed circuit board, a gap between the cover and a lid is filled with an insulating compound for preventing liquid ingress, and then the power plug device is sealed by using an ultrasonic welding.

18 Claims, 9 Drawing Sheets

POWER PLUG DEVICE AND THE MANUFACTURING METHOD THEREOF

TECHNICAL FIELD

The present invention relates to a power plug device and the manufacturing method thereof, and more especially relates to a power plug device with water resistant and the manufacturing method thereof.

BACKGROUND

Power plug device is used to connect to a power socket for delivering current to the electrical appliances, such as television, refrigerator, shaver, or hair dryer, and thus the electrical appliances can be operated. Some of the electrical appliances may be used in the moist atmosphere such as bathroom, and hence it is very important that the power plug devices can be used safely in the moist atmosphere and have function of waterproof.

International Protection Marking, Ingress Protection Rating or IP Code is generally known as to define the degree of protection for preventing solid and liquid particles from penetrating into the mechanical or electrical appliances. The first digit of IP Code represents the level of protection against the penetration of external solid particles, and classified by level 0 to 6. The level 0 indicates a null protection against contact and ingress of objects, and the level 6 indicates a complete protection against contact and no ingress of dusts. The higher first digit of IP Code indicates the greater protection against the ingress of objects. The second digit of IP Code represents the level of protection for the enclosure of mechanical or electrical appliances against the ingress of water, and classified by level 0 to 8. The level 0 indicates no protection against the ingress of water, and the level 8 indicates protection for the enclosure of mechanical or electrical appliances immersing water over. The higher numeral indicates the greater protections harmful ingress of water. If the mechanical casings or the electrical enclosures cannot provide any protective level of solid particle protection or liquid ingress protection, the digit will be replaced with the letter X. For instance, a power plug device with protection class IPX7 is known that it has no protection provided against solid particle, but contains protection against temporary submersion when the device is immersed 1000 mm below the surface of the water.

Conventionally, a power plug device with protection class IPX7 is sealed by filling the inner space of the power plug device with an insulating compound completely for increasing the protection against the liquid ingress, such as filling the epoxy. The filled insulating compound often covers the inner elements of the power plug device, including a printed circuit board and a cable.

Except the inner space of the power plug device filled with the insulating compound, the power plug device is normally sealed by using an ultrasonic welding technology. The principle of the ultrasonic welding technology is based on converting the high-frequency of sound signal into the frictional heat by an energy converter. The horn of the energy converter contacts to the plastic material so that the temperature of the contact area increases under the frictional heat generated from the vibration of molecular of the plastic material. When the temperature of the contact area is increased over the melting point of the plastic material, the plastic material will be melt together and form a solid body after cooling down.

The power plug device is employed by filling the insulating compound and by an ultrasonic welding technology for preventing the liquid ingress. However, the weight of power plug device is increasing due to the requirement of more filled insulating compound in the conventional power plug. Thus, the present invention is proposed to overcome the disadvantages mentioned above.

SUMMARY OF THE INVENTION

The object of the present invention is to provide a power plug device with protection class IPX7 for preventing liquid ingress.

Another object of the present invention is to provide a power plug device with less weight than the traditional water-resistant power plug device.

Another object of the present invention is to provide a power plug device and the manufacturing method thereof, the power plug device comprises a power-connected base; a cover is configured to the power-connected base, wherein the cover can cover the internal components of the power-connected base, such as at least one plug and a printed circuit board, a gap between the cover and a lid is filled with an insulating compound for preventing liquid ingress, and then the power plug device is sealed by using an ultrasonic welding.

For achieving the objects above, in one aspect, the present invention provides a power plug device. The power plug device comprises a power-connecting base having at least one plug, wherein an inner edge of said power-connecting base comprises a plurality of supporting elements; a printed circuit board having a first region and a second region, wherein said first region is electrically coupled to said at least one plug; a cover having a concave portion surrounded with a rim, wherein said second region of said printed circuit board is configured into said concave portion, and said rim is placed on said plurality of supporting elements, wherein said cover is configured with a hole; a cable is electrically coupled to said printed circuit board via said hole; and a lid is configured with said power-connecting base and on said cover, wherein a gap between said cover and said lid is filled with an insulating compound for preventing liquid ingress.

The power plug device of the present invention, wherein the power-connecting base comprises at least one passage, and the at least one plug is passed through the at least one passage, wherein the hole is located on the rim.

The power plug device of the present invention, wherein the first region of the printed circuit board comprises at least one first contact and the second region comprises at least one second contact, wherein the plug is electrically coupled to the first contact and the cable is electrically coupled to the second contact.

The power plug device of the present invention, wherein the power-connecting base further comprises a base opening, the cable is mounted into the base opening.

The power plug device of the present invention, wherein the cable comprises a strain relief, the strain relief is mounted into the base opening.

The power plug device of the present invention, wherein the width and the high of the second region of the printed circuit board corresponds to the inner width and the inner high of the concave portion.

The power plug device of the present invention, wherein the location of the supporting elements is corresponded with the common border between the first region and the second region.

The power plug device of the present invention, wherein the width of the first side of the first region corresponds to the width of the concave portion.

The power plug device of the present invention, wherein said insulating compound is filled at least covering said cable.

In another aspect, the present invention provides a method for manufacturing a power plug device, the method comprises connecting a cover with a cable by passing said cable through a hole of the cover; mounting a concave portion of the cover on a second region of a printed circuit board and electrically coupling the second region to the cable; configuring the combined cable, cover, and printed circuit board into an inner side of said power-connecting base, wherein said power-connecting base is configured with at least one plug, the plug is electrically coupled to a first region of the printed circuit board; filling an insulating compound into a gap; mounting a lid on the cover and connecting the lid with the power-connecting base; and sealing said power plug device by using an ultrasonic welding.

The method of the present invention, wherein the second region of the printed circuit board comprises at least one second contact for electrically coupling to the cable; wherein the first region of the printed circuit board comprises at least one first contact for electrically coupling to the plug.

The method of the present invention, wherein the power-connecting base comprises at least one passage, and the at least one plug is passed through the at least one passage.

The method of the present invention, wherein an inner edge of said power-connecting base comprises a plurality of supporting elements, wherein the cover is mounted on the supporting elements.

The method of the present invention, wherein the power-connecting base comprises a base opening.

The method of the present invention, wherein the cable comprises a strain relief, wherein the strain relief is mounted into the base opening.

The method of the present invention, wherein the insulating compound is filled at least covering the cable.

BRIEF DESCRIPTION OF THE DRAWINGS

The present invention may be understood by some preferred embodiments and detailed description in the specification and the attached drawing below. The identical reference numbers in the drawings refer to the same components in the present invention. However, it should be appreciated that all the preferred embodiments of the present invention are provided only for illustrating but not for limiting the scope of the Claims and wherein:

DETAILED DESCRIPTION

Some preferred embodiments of the present invention will now be described in greater detail. However, it should be recognized that the preferred embodiments of the present invention are provided for illustration rather than limiting the present invention. In addition, the present invention can be practiced in a wide range of other embodiments besides those explicitly described, and the scope of the present invention is not expressly limited except as specified in the accompanying claims.

Figure 1:
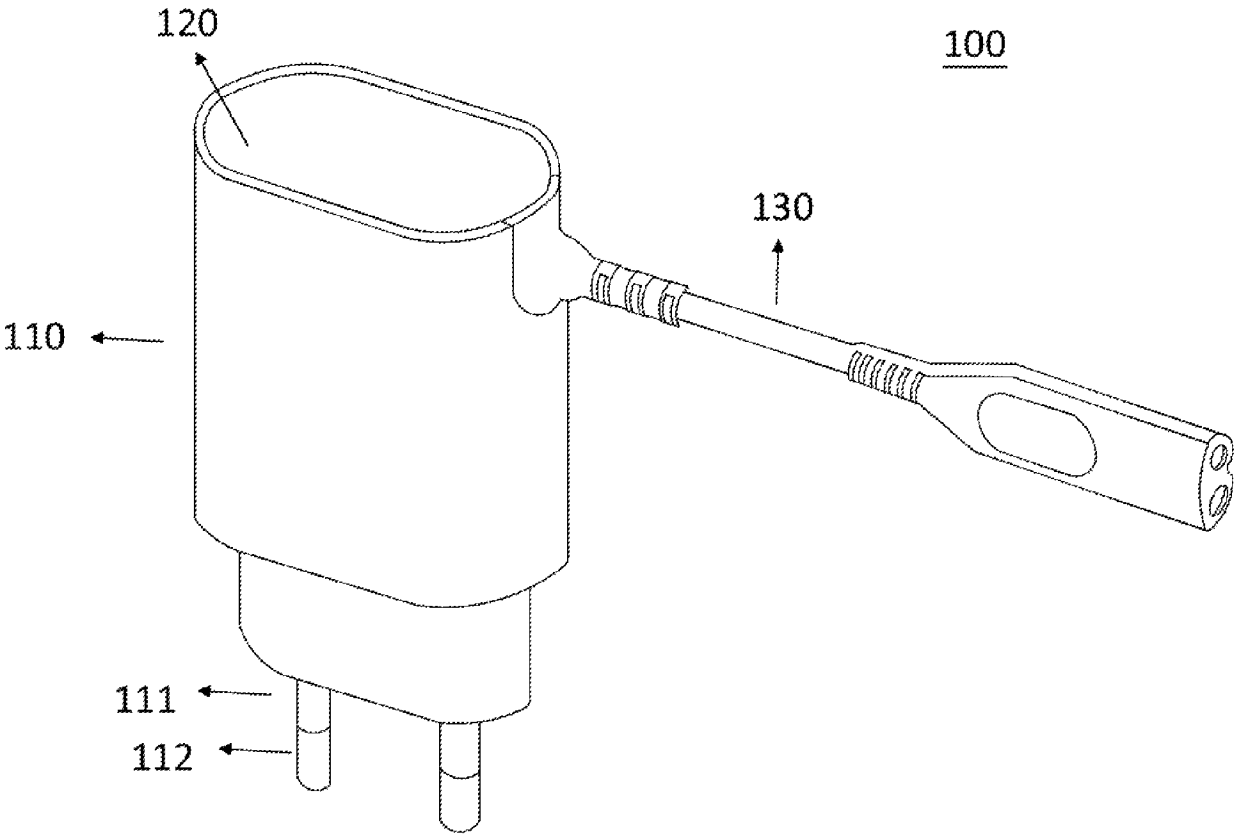
FIG. 1 illustrates a perspective view of a power plug device in accordance with one embodiment of the present invention.

FIG. 1 is a perspective view of a power plug device in accordance with one embodiment of the present invention. The external construction of the power plug device 100 comprises a power-connecting base 110, a lid 120 and a cable 130, wherein the power-connecting base 110 is formed by an integration molding, and further comprises at least one passage 111, wherein at least one plug 112 may be configured into the passage. In the following, the interior construction of the power plug device will be described in detail.

Figure 2:
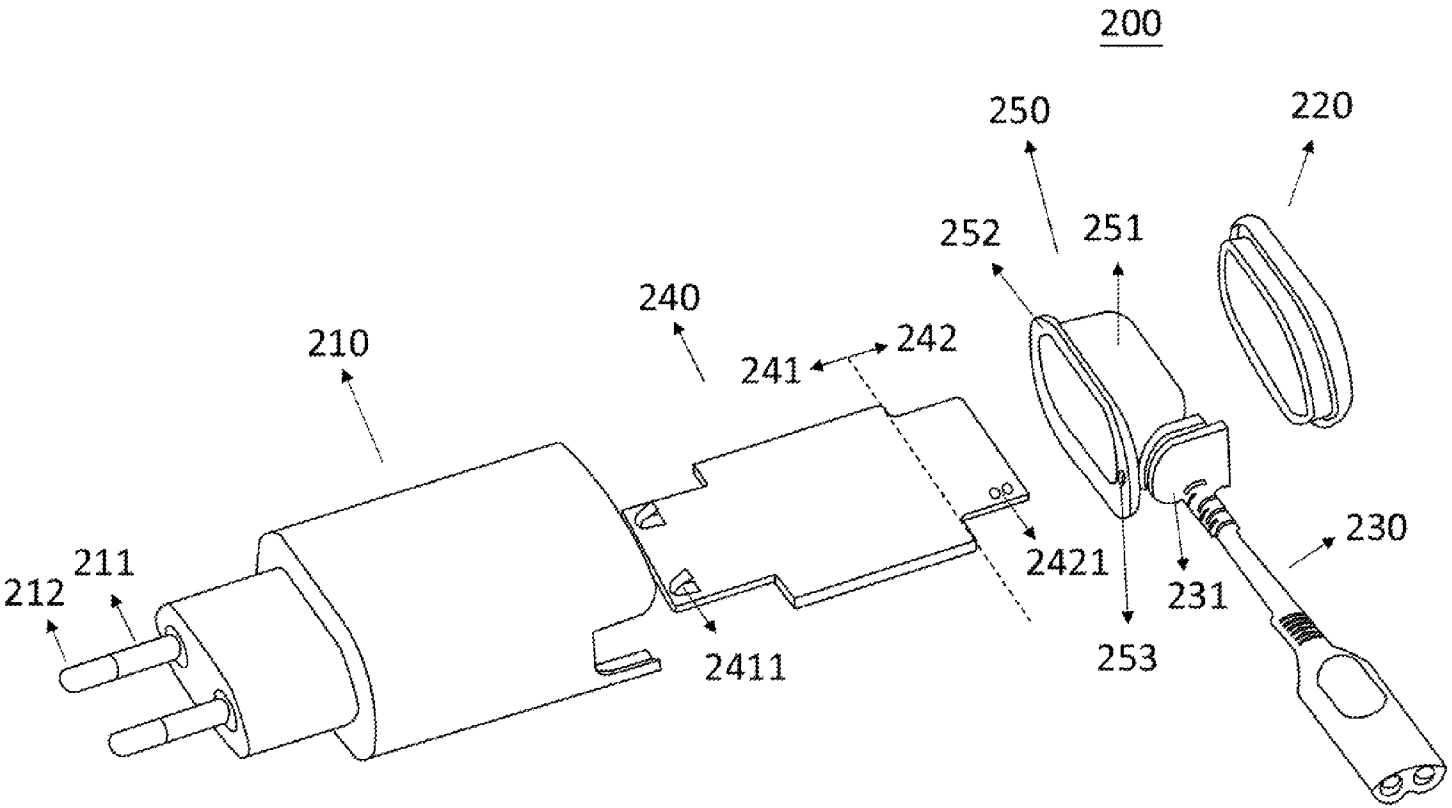
FIG. 2 illustrates an exploded view of the power plug device of the FIG. 1.
Figure 3:
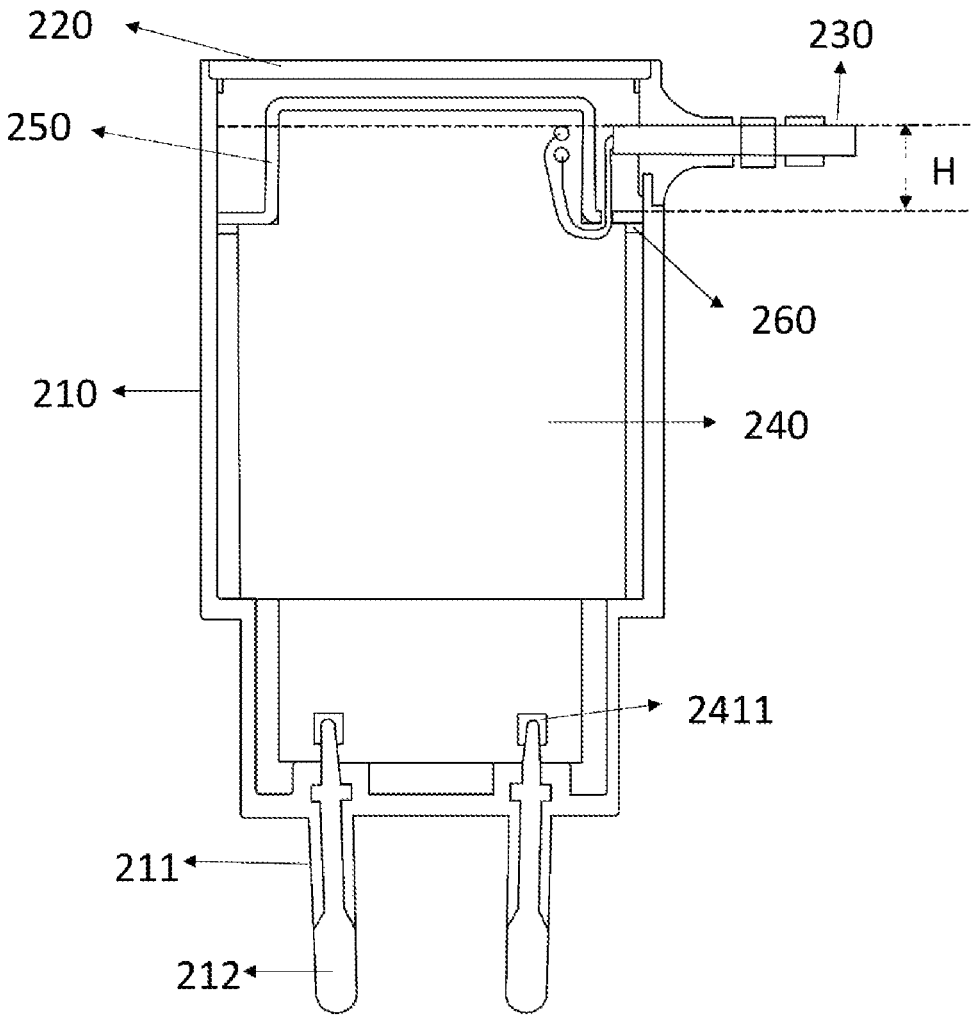
FIG. 3 illustrates a cross-section view of the power plug device of the FIG. 1.

FIG. 2 and FIG. 3 are respectively showing an exploded view and a cross-section view of the power plug device of the FIG. 1. The power plug device of the present invention comprises a power-connecting base 210, a lid 220, a cable 230, a printed circuit board 240, and an inner cover 250, wherein the power-connecting base 210 is configured to receive the printed circuit board 240 and the inner cover 250. The power-connecting base 210 may be configured with at least one plug 212 for electrically coupling to an external power source to transmit the current to the printed circuit board 240 of the power-connecting base 210. The current transmitted from the plug 212 is received by the printed circuit board 240. The inner cover 250 is configured with a concave portion 251 for accommodating a second region 242 of the printed circuit board 240 and fixing thereon. A rim 252 locates around the concave portion 251, and the rim 252 has a hole 253 as shown in the FIG. 5A. The cable 230 is passed through the hole 253 for electrically coupling to the second region 242. A lid 220 may be configured on the inner cover 250 and mounted on the power-connecting base 210, wherein the gap between the inner cover 250 and the lid 220 is filled with an insulating compound 270 for preventing liquid ingress. In one embodiment, the first region 241 of the printed circuit board 240 is configured with at least one first contact 2411 and the second region 242 of the printed circuit board 240 is configured with at least one second contact 2421, wherein the at least one first contact 2411 may be electrically connected to the interior plug 212 of the power-connecting base 210, and the at least one second contact 2421 is electrically connected to the cable 230. In other embodiment, the at least one second contact 2421 may be located on the first region 241.

In one embodiment of the present invention, only the gap between the inner cover 250 and the lid 220 is filled with an insulating compound for preventing the liquid ingress, and it should be avoid increasing the weight of the power plug device due to filling more insulating compound. After the power-connecting base 210 is assembled, the assembled power plug device is completely sealed by using an ultrasonic welding, which includes welding the lid 220 with the power-connecting base 210 and welding the at least one passage 211 with the at least one plug 212.

In one embodiment, the hole 253 of the inner cover 250 may be located on the concave portion 251 or the rim 252. As shown in FIG. 2 and FIG. 3, the hole 253 is located on the rim 252.

In the other embodiment, the filled insulating compound 270 is at least covering the cable 230, with reference to the dotted line of FIG. 3. Since the hole 253 of FIG. 3 is located on the rim 252, the insulating compound 270 is only needed to be filled up to the height 'H' as shown in FIG. 3 for effectively preventing the liquid ingress and decreasing the weight of the power plug device. It should be understood that the shorter "H" between the cable 230 and the rim 252, the fewer insulating compound 270 is filled such that the weight of the power plug device can be decreased effectively.

In one embodiment, the filled insulating compound 270 may be epoxy, also known as artificial resins, polyepoxides. Epoxy is a thermosetting polymer, often with less shrinkage, low volatility, and moisture resistance after epoxy is harden.

In another embodiment, after the lid 220 is engaged/mounted on the power-connecting base 210, the present invention uses an ultrasonic welding technology to weld the lid 220 on the power-connecting base 210 such that the power plug device 100 is completely sealed.

With reference to FIG. 2 and FIG. 3 in one embodiment of the present invention, the power-connecting base 210 is formed by an integration molding and further comprises at least one passage 211, wherein the at least one plug 212 is configured into the passage 211 for electrically coupling to an external power source to transmit the current to the printed circuit board 240 of the power-connecting base 210.

With reference to FIG. 2 in one embodiment of the present invention, the cable 230 is configured to transmit current to the electrical appliance, wherein the cable 230 comprises a strain relief 231 in order to avoid the cable 230 being destroyed by folding. The power-connecting base 210 may be configured with a base opening 280, and the strain relief 231 may be mounted into the base opening 280. In the other embodiment, the lid may comprise a lid opening, and the strain relief 231 may be configured into the lid opening (not shown in the figures).

Figure 4:
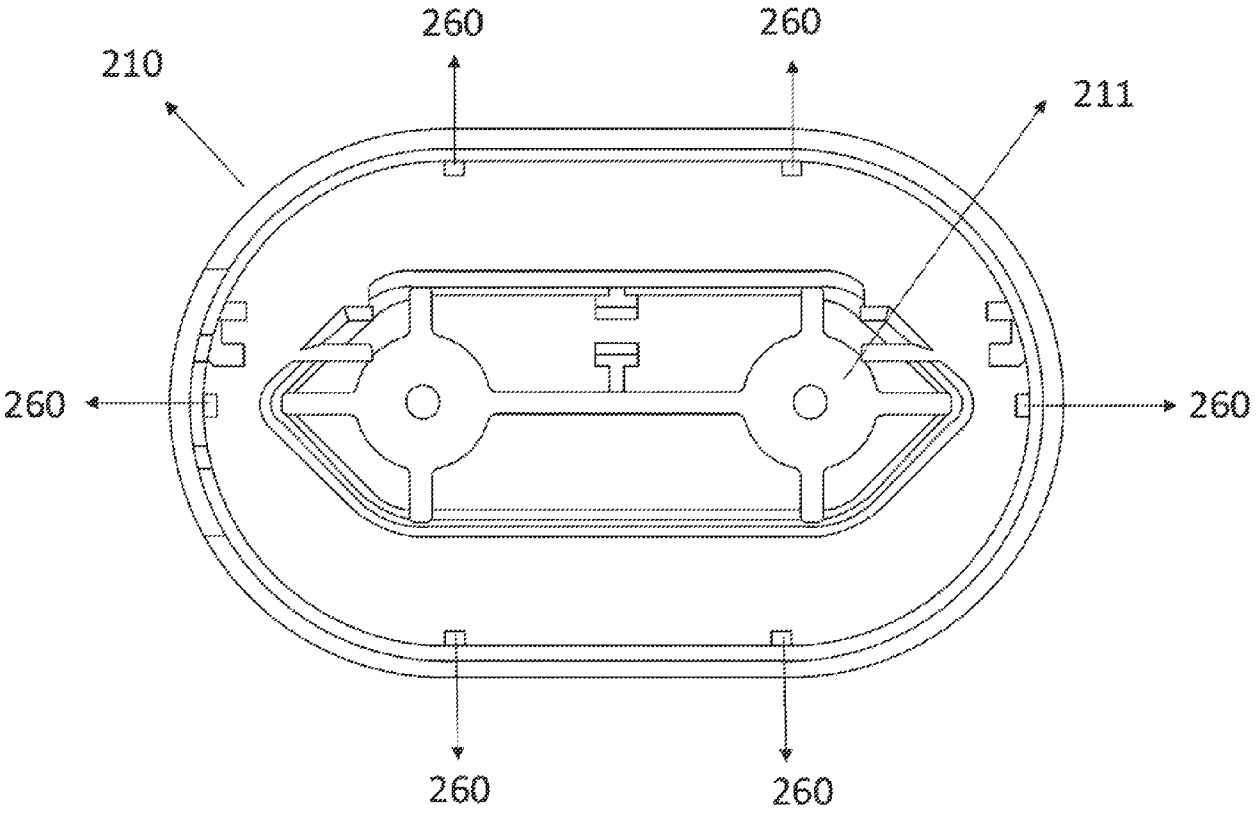
FIG. 4 illustrates a top view of a power-connecting base of the power plug device of the FIG. 1.

With reference to FIG. 4, showing a top view of a power-connecting base 210 of the present invention, the inner edge of the power-connecting base 210 may be configured with a plurality of supporting elements 260. The supporting elements 260 are protruded from the inner edge of the power-connecting base 210, wherein the protrusion structure may be a prism. In one embodiment of FIG. 3 and FIG. 4, the supporting elements 260 are with rectangular body, wherein the rim 252 of the cover 250 is placed on the supporting elements 260. In one embodiment of the present invention, the inner edge of the power-connecting base 210 comprises six supporting elements 260.

In one embodiment, the width and the high of the second region 242 of the printed circuit board 240 corresponds to the inner width and high of the concave portion 251 respectively, such that the second region 242 of the printed circuit board 240 may be fixed into the inner of the concave portion 251. With reference to FIG. 3, the location of the supporting elements 260 may be set corresponding to the common boundary between the first region 241 and the second region 242 after the cover 250 and the printed circuit board 240 are configured into the power-connecting base 210.

In one embodiment, the width of a first side, which is corresponding to the common boundary with the second region 242, of the first region 241 corresponds to the width of the concave portion 251 such that the rim 252 may be placed on the first side of the first region 241 while the second region 242 being fixed into the concave portion 251 with reference to FIG. 3.

The present invention provides a power plug device comprising an inner cover configured in the power-connecting base, wherein the inner cover covers the interior elements of the power-connecting base, such as the plug and the printed circuit board, and the gap between the cover and the lid is filled with the insulating compound, and then the power plug device is sealed by using an ultrasonic welding for preventing the liquid ingress.

Figure 5A:
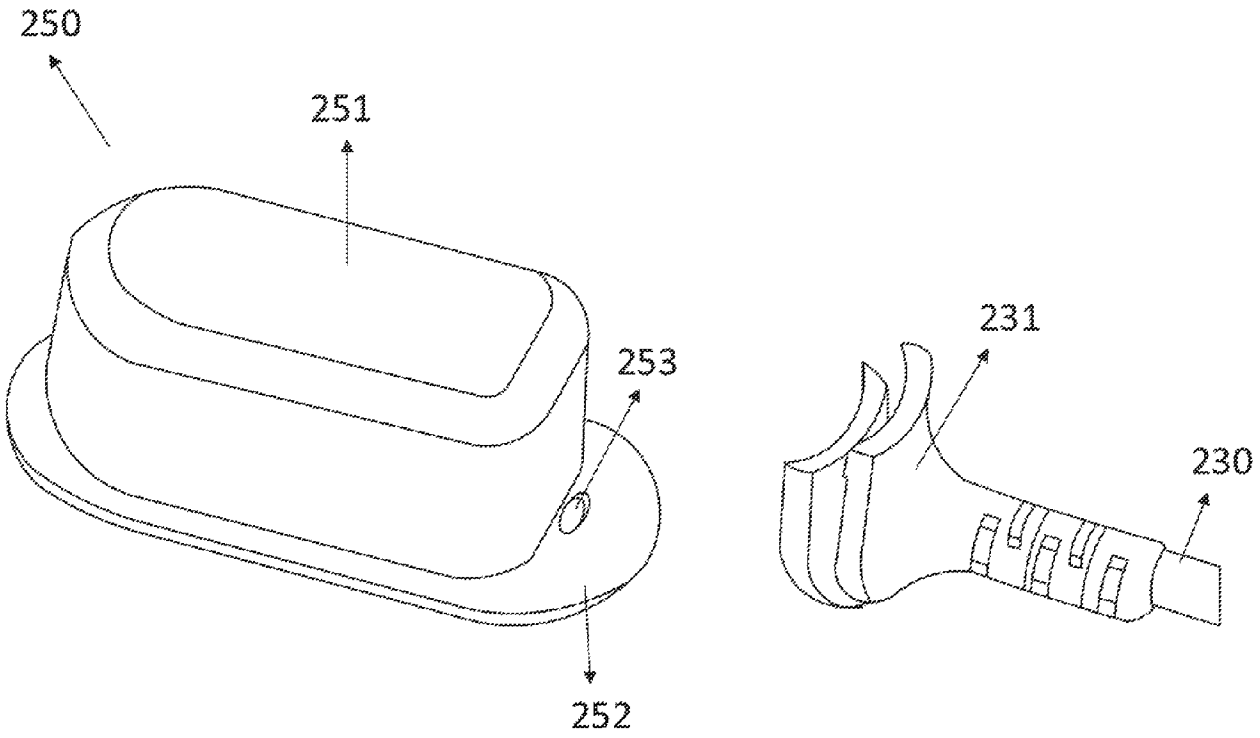
FIG. 5A illustrates a perspective view of a cover and a cable and shows the first manufacturing step of the power plug device of the FIG. 1.
Figure 5B:
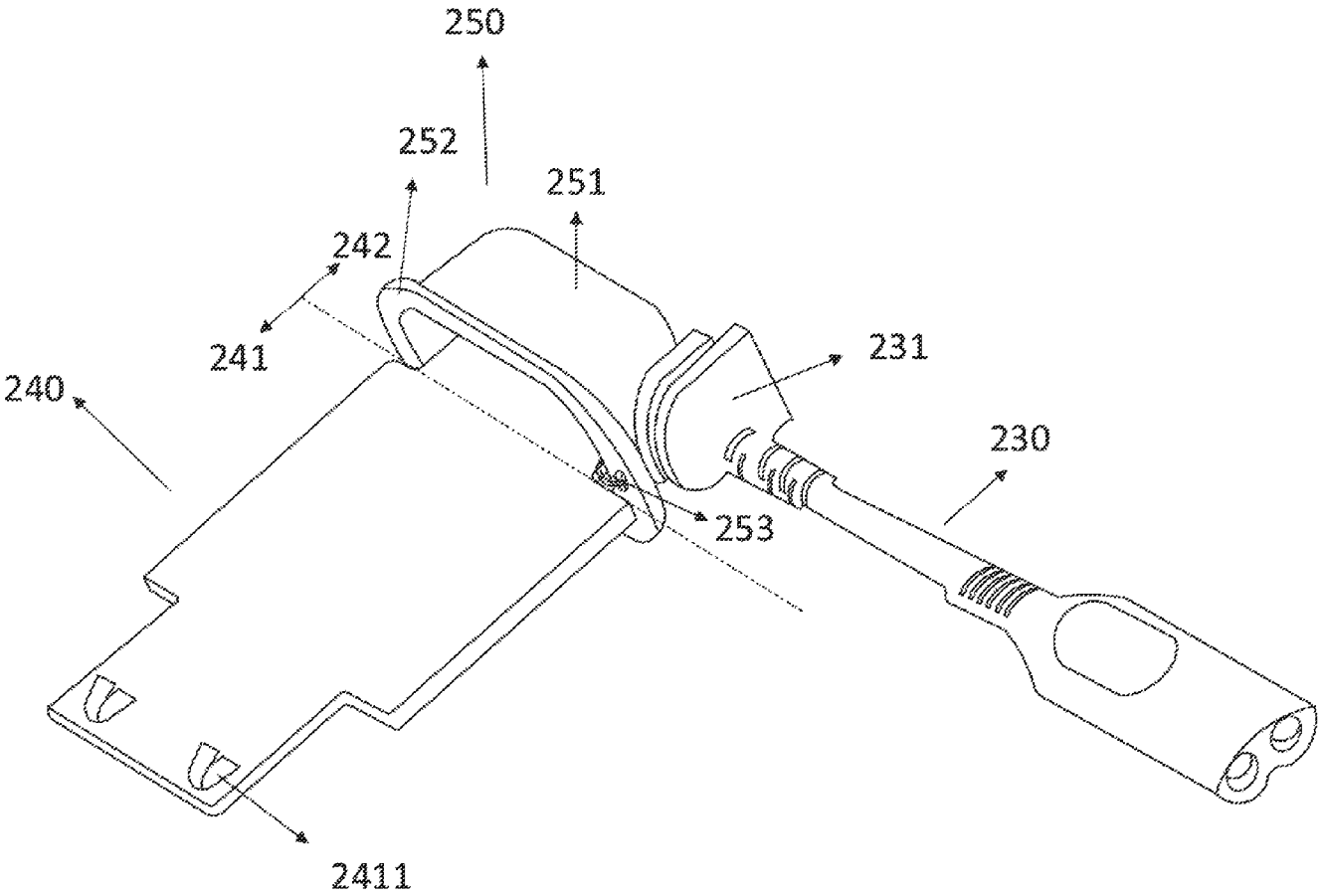
FIG. 5B illustrates a perspective view of the cover within a printed circuit board and shows the second manufacturing step of the power plug device of the FIG. 1.
Figure 5C:
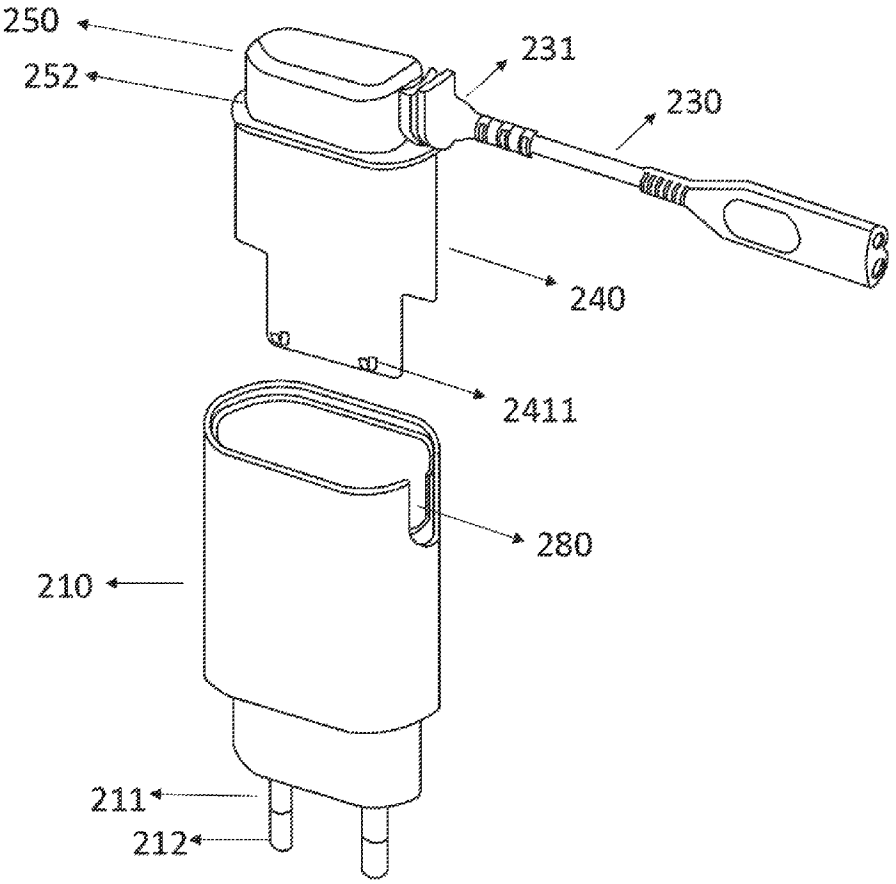
FIG. 5C illustrates a perspective view of the elements of the FIG. 5B prior to arranging into a power-connecting base and shows the third manufacturing step of the power plug device of FIG. 1.
Figure 5D:
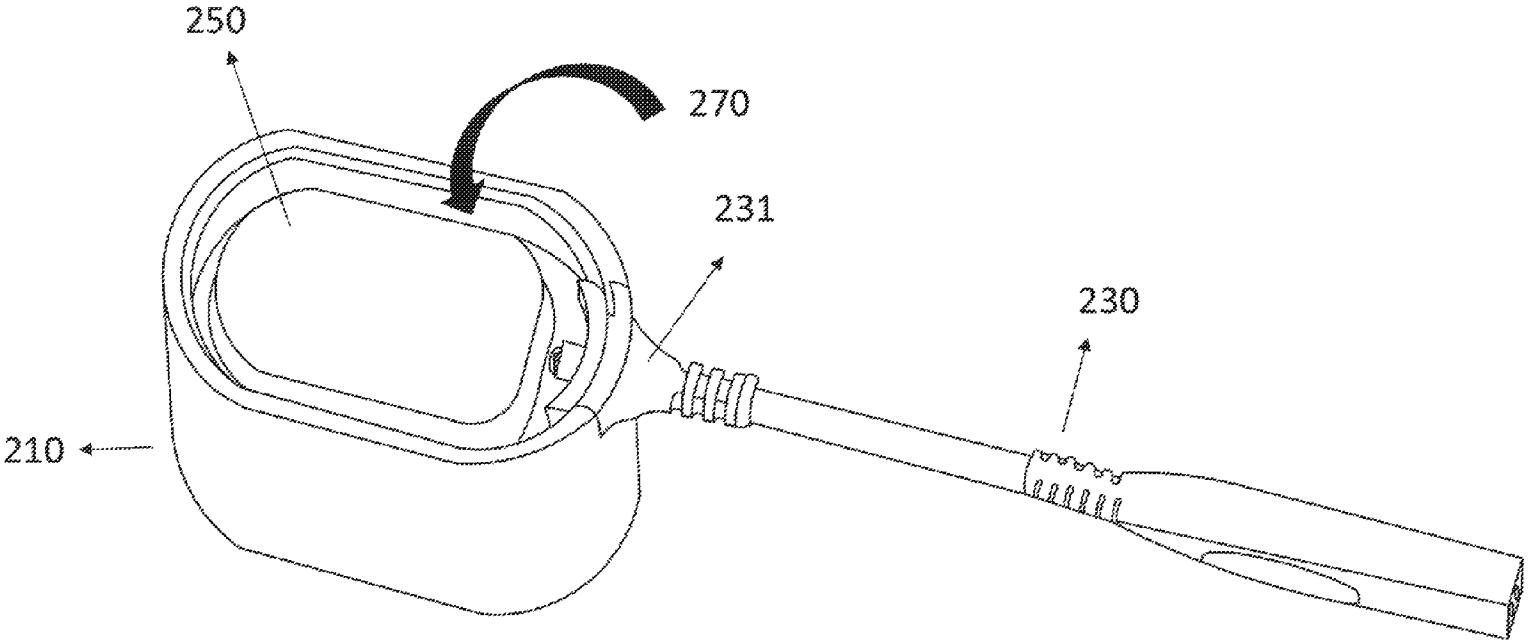
FIG. 5D illustrates a top lateral view of the power-connecting base within arranged elements of the FIG. 5B and shows the forth manufacturing step of the power plug device of FIG. 1.
Figure 5E:
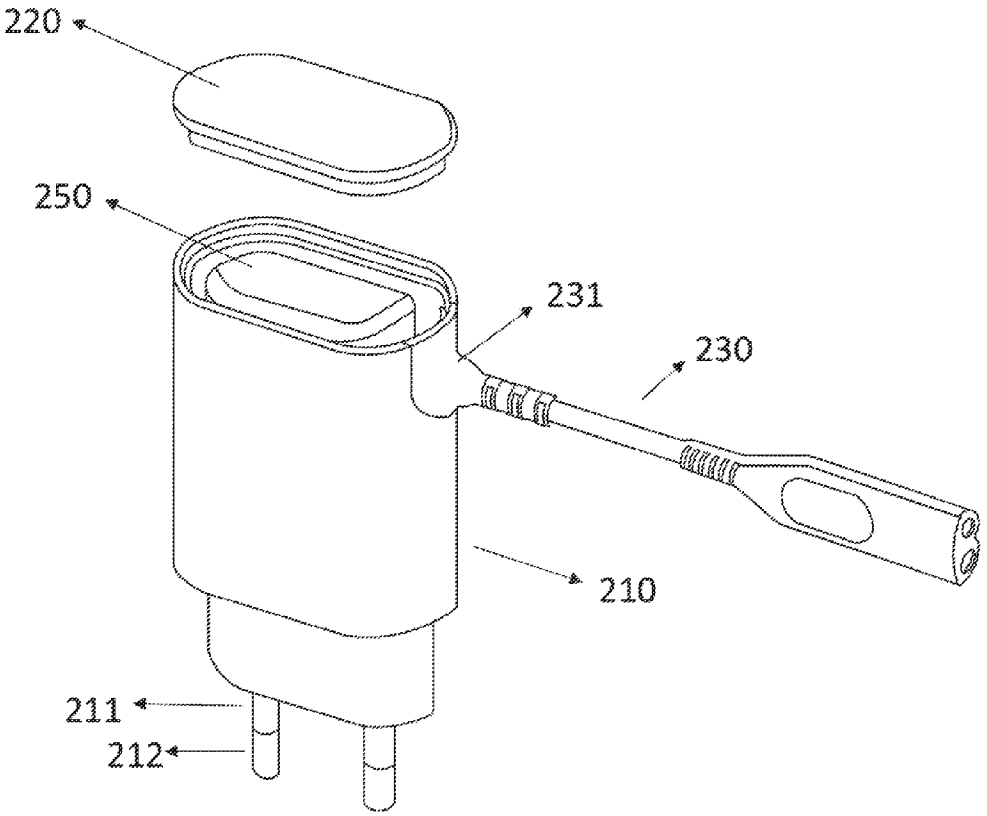
FIG. 5E illustrates a top lateral view of the power-connecting base of the FIG. 5D, which has been filled with an insulating compound, prior to connecting with a lid and shows the forth manufacturing step of the power plug device of the FIG. 1.

With reference to FIG. 5A to FIG. 5E, they show the manufacturing method of a power plug device 200 of the present invention. FIG. 5A shows the first step of the manufacturing method, which a cable 230 is connected to an inner cover 250 by passing the cable 230 through a hole 253 of the inner cover 250. FIG. 5B shows the second step of the manufacturing method, which a second region 242 of a printed circuit board 240 is mounted on a concave portion 251 of the inner cover 250, wherein the second region 242 of the printed circuit board 240 is electrically coupled to the cable 230. FIG. 5C shows the third step of the manufacturing method, which the combined cable 230, inner cover 250 and printed circuit board 240 are configured into an inner side of the power-connecting base 210, wherein the power-connecting base 210 is configured with at least one plug 212 for electrically coupling to an external power source to transmit the current to the printed circuit board 240. FIG. 5D shows the forth step of the manufacturing method, which an insulating compound 270 is filled into the inner cover 250. FIG. 5E shows the fifth step of the manufacturing method, which a lid 220 is configured on the inner cover 250 and mounted on the power-connecting base 210. Then, the closed power plug device 200 is sealed by using an ultrasonic welding (not shown in the figures) the lid 220 with the power-connecting base 210.

In one embodiment, the second region 242 of the printed circuit board 240 comprises at least one second contact 2421 for electrically coupling to the cable 230.

In one embodiment, the power-connecting base 210 is formed by an integration molding and further comprises at least one passage 211, which is passed through by the at least one plug 212. The first region 240 of the printed circuit board 240 of the power-connecting base 210 is electrically coupled the at least one plug 212 in the power-connecting base 210.

In one embodiment, the filled insulating compound 270 covers at least the cable 230, with reference to the dotted line of FIG. 3. In FIG. 3, the cable 230 is passed through the hole located on the rim such that the insulating compound is only needed to be filled up to the dotted line, or the height "H" for preventing the liquid ingress and decreasing the weight of the power plug device 200.

In one embodiment, the inner edge of the power-connecting base 210 may comprise a plurality of supporting elements 260, and the inner cover 140 may be placed on the supporting elements 260.

With reference to FIG. 5C and FIG. 5D, the cable 230 comprises a strain relief 231, and the strain relief 231 is mounted on a base opening 280 of the power-connecting base 210 for avoiding the cable 230 destroyed from folding. In another embodiment, the strain relief 231 may be mounted on a lid opening (not shown in the figures) of the lid.

As described above, the present invention provides a power plug device and the manufacturing method thereof. The power plug device comprises an inner cover configured in the power-connecting base, wherein the inner cover protects the interior elements of the power-connecting base, such as the plug and the printed circuit board, the gap between the cover and the lid is filled with the insulating compound, the weight of the power plug device is decreased because of the fewer insulating compound is filled, then the power plug device is sealed by using an ultrasonic welding for preventing the liquid ingress.

The foregoing description is a preferred embodiments of the present invention. It should be appreciated that these embodiments are described for purpose of illustration only, not for limiting, and that numerous alterations and modifications may be practiced by those skilled in the art without departing from the spirit and the scope of the present invention. It is intended that all such modifications and alterations are included insofar as they come within the scope of the present invention as claimed or the equivalents thereof.

What is claimed is:

1. A power plug device, comprising:

a power-connecting base, having at least one plug, wherein an inner edge of said power-connecting base comprises a plurality of supporting elements;

a printed circuit board, having a first region and a second region, wherein said first region is electrically coupled to said at least one plug;

a cover, having a concave portion surrounded with a rim, wherein said second region of said printed circuit board is configured into said concave portion, and said rim is placed on said plurality of supporting elements, wherein said cover is configured with a hole;

a cable, electrically coupled to said printed circuit board via said hole;

a lid, configured with said power-connecting base and on said cover, wherein only the rim of said cover is filled with an insulating compound for lightening weight of said power plug device and preventing liquid ingress; and an ultrasonic welding seal configured to seal said power plug device.

2. The device of claim 1, wherein said power-connecting base comprises at least one passage, and said at least one plug is passed through said at least one passage.

3. The device of claim 1, wherein said first region of said printed circuit board comprises at least one first contact and said second region comprises at least one second contact, wherein said at least one first contact is electrically connected to said at least one plug, and said at least one second contact is electrically connected to said cable.

4. The device of claim 1, wherein said hole is located on said rim.

5. The device of claim 1, wherein said power-connecting base further comprises a base opening, said cable is mounted into said base opening.

6. The device of claim 5, wherein said cable comprises a strain relief, said strain relief is mounted into said base opening.

7. The device of claim 1, wherein the width and the high of said second region of said printed circuit board corresponds to the inner width and the inner high of said concave portion.

8. The device of claim 1, wherein the location of said supporting elements is corresponded with the common border between said first region and said second region.

9. The device of claim 1, wherein the width of a first side of said first region corresponds to the width of said concave portion.

10. The device of claim 1, wherein said insulating compound is filled at least covering said cable.

11. A method for manufacturing a power plug device, including:

connecting a cover with a cable by passing said cable through a hole of said cover;

mounting a concave portion surrounded with a rim of said cover on a second region of a printed circuit board and electrically coupling said second region to said cable;

configuring the combined said cable, said cover, and said printed circuit board into an inner side of a power-connecting base, wherein said power-connecting base is configured with at least one plug, said at least one plug is electrically coupled to a first region of said printed circuit board;

only filling an insulating compound into the rim of said cover;

mounting a lid on said power-connecting base; and an ultrasonic welding seal configured to seal said power plug device.

12. The method of claim 11, wherein said second region of said printed circuit board comprises at least one second contact for electrically coupling to said cable.

13. The method of claim 11, wherein said first region of said printed circuit board comprises at least one first contact for electrically coupling to said at least one plug.

14. The method of claim 11, wherein said power-connecting base comprises at least one passage, and said at least one plug is passed through said at least one passage.

15. The method of claim 11, wherein an inner edge of said power-connecting base comprises a plurality of supporting elements, wherein said cover is mounted on said plurality of supporting elements.

16. The method of claim 11, wherein said power-connecting base comprises a base opening.

17. The method of claim 11, wherein said cable comprises a strain relief, wherein said strain relief is mounted into said base opening.

18. The method of claim 11, wherein said insulating compound is filled at least covering said cable.

* * * * *